US011644777B2

(12) United States Patent
Ishifuji et al.

(10) Patent No.: US 11,644,777 B2
(45) Date of Patent: May 9, 2023

(54) PRESSURIZING MEMBER, FIXING DEVICE, AND ELECTROPHOTOGRAPHIC IMAGE-FORMING APPARATUS

(71) Applicant: CANON KABUSHIKI KAISHA, Tokyo (JP)

(72) Inventors: Ryo Ishifuji, Ibaraki (JP); Hiroki Muramatsu, Tokyo (JP); Yasuharu Notoya, Tokyo (JP); Yohei Miyauchi, Tokyo (JP); Naoko Kasai, Kanagawa (JP); Yusuke Baba, Kanagawa (JP); Masaaki Takahashi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/826,632

(22) Filed: May 27, 2022

(65) Prior Publication Data

US 2022/0390885 A1 Dec. 8, 2022

(30) Foreign Application Priority Data

Jun. 4, 2021 (JP) ..... JP2021-094732

(51) Int. Cl.
*G03G 15/20* (2006.01)

(52) U.S. Cl.
CPC ..... *G03G 15/2064* (2013.01)

(58) Field of Classification Search
USPC ..... 399/318
See application file for complete search history.

(56) References Cited

U.S. PATENT DOCUMENTS

| | | | |
|---|---|---|---|
| 6,658,230 | B2 | 12/2003 | Satoh |
| 7,254,361 | B2 | 8/2007 | Satoh |
| 2022/0206419 | A1 | 6/2022 | Muramatsu et al. |
| 2022/0206420 | A1 | 6/2022 | Kasai et al. |
| 2022/0206421 | A1 | 6/2022 | Miyauchi et al. |

FOREIGN PATENT DOCUMENTS

| | | | | |
|---|---|---|---|---|
| JP | 2002-258653 | A | 9/2002 | |
| JP | 2003-084609 | A | 3/2003 | |
| JP | 4478342 | B2 * | 6/2010 | ..... G03G 15/2064 |
| JP | 2014-232208 | A | 12/2014 | |
| JP | 2017-223793 | A | 12/2017 | |

* cited by examiner

*Primary Examiner* — Quana Grainger
(74) *Attorney, Agent, or Firm* — Venable LLP

(57) ABSTRACT

Provided is a pressurizing member including a substrate, an elastic layer on the substrate, and a surface layer on the elastic layer, the surface layer containing a fluorine resin, wherein the surface layer has a surface resistivity of $1\times10^{11}$ [Ω/□] or less at a temperature of 25° C. when applying a DC voltage of 500 V, and a thermal conductivity λ in a thickness direction of the surface layer is 0.093 [W/(m·K)] or less.

12 Claims, 5 Drawing Sheets

PRESSURIZING MEMBER, FIXING DEVICE, AND ELECTROPHOTOGRAPHIC IMAGE-FORMING APPARATUS

BACKGROUND

Technical Field

The present disclosure relates to a pressurizing member, a fixing device, and an electrophotographic image-forming apparatus.

Description of the Related Art

An electrophotographic image-forming apparatus (hereinafter also referred to as "image-forming apparatus"), such as a copying machine or a laser printer, includes a fixing device for fixing an unfixed toner image formed on a recording material to the recording material by heating and pressurizing the image. The fixing device includes a heating member and a pressurizing member arranged to face each other. The heating member and the pressurizing member are brought into press contact with each other while rotating in directions opposite to each other. Thus, a nip for conveying the recording material in a sandwiched manner is formed. Then, when the recording material passes through the nip portion, the unfixed toner image is heated and pressurized to be fixed as a fixed image to the recording material.

In a pressurizing member to be used for a fixing device for electrophotography, to suppress the adhesion of toner, as a surface layer for forming an outer surface of the pressurizing member (hereinafter referred to as "surface layer"), there may be used a surface layer containing a fluorine resin, specifically, a copolymer of tetrafluoroethylene (—$C_2F_4$—) and a perfluoroalkyl vinyl ether (—$CF_2$—$CF(OR_f)$—) (hereinafter also referred to as "PFA"). Herein, the symbol "$R_f$" represents a perfluoroalkyl group.

In recent years, from the viewpoint of shortening a first print time, the shortening of a time period required for the heating member to reach a sufficient temperature at which the toner image can be fixed (hereinafter referred to as "start time") has been required. To that end, the suppression of heat transfer from the heating member to the pressurizing member at the time of the fixation through a reduction in thermal conductivity of the surface layer of the pressurizing member by the porosification thereof is effective. In addition, in Japanese Patent Application Laid-Open No. 2014-232208, there is a disclosure of a member for pressurization whose surface includes a layer containing: a fluorine resin; and hollow particles whose outer shells are each formed of an inorganic material.

Incidentally, a phenomenon called an electrostatic offset may occur in a fixing step. The phenomenon is as described below. As a result of sliding between the heating member and the pressurizing member, the surface of the pressurizing member facing the heating member (hereinafter also simply referred to as "outer surface") is charged to the same polarity as that of the unfixed toner, and hence a repulsive force on the unfixed toner occurs in the nip portion or a vicinity thereof to cause the unfixed toner to fly to the heating member. The prevention of the charging of the outer surface of the pressurizing member is effective in preventing the electrostatic offset.

Herein, the inventors have made an investigation on further porosification of the surface layer for further reducing the thermal conductivity of the surface layer in its thickness direction. In the process, the inventors have found that as the porosification of the surface layer is advanced, even when the surface layer contains an electro-conductive material such as carbon black, the surface resistivity of its outer surface may increase to make it easier for the electrostatic offset to occur. That is, the inventors have obtained a finding that it is difficult to achieve both of a further improvement in heat-insulating property of the surface layer in the thickness direction and a reduction in surface resistivity of the outer surface.

SUMMARY

At least one aspect of the present disclosure is directed to providing a pressurizing member for electrophotography, which is improved in heat-insulating property in its thickness direction while being suppressed in increase in resistance of its outer surface.

In addition, another aspect of the present disclosure is directed to providing a fixing device, which can further shorten a first print time and more satisfactorily prevent the occurrence of an electrostatic offset. Further, still another aspect of the present disclosure is directed to provide an electrophotographic image-forming apparatus, which has a further shortened first print time and can stably form a high-quality electrophotographic image.

According to one aspect of the present disclosure, there is provided a pressurizing member including: a substrate; an elastic layer on the substrate; and a surface layer on the elastic layer, the surface layer containing a fluorine resin, wherein the surface layer has a surface resistivity of $1\times10^{11}$ [Ω/□] or less at a temperature of 25° C. when applying a DC voltage of 500 V, and a thermal conductivity λ in a thickness direction of the surface layer is 0.093 [W/(m·K)] or less.

In addition, according to another aspect of the present disclosure, there is provided a fixing device including: the pressurizing member; and a heating member arranged to face the pressurizing member. In addition, according to still another aspect of the present disclosure, there is provided an electrophotographic image-forming apparatus including the fixing device.

Further features of the present disclosure will become apparent from the following description of exemplary embodiments with reference to the attached drawings.

DESCRIPTION OF THE EMBODIMENTS

The inventors have made investigations with a view to obtaining a pressurizing member that can prevent the occurrence of an electrostatic offset and can reduce the movement of a heat quantity from a heating member. As a result, the inventors have found that a pressurizing member having the following configuration is conducive to the solution of the above-mentioned problem. That is, a pressurizing member according to one aspect of the present disclosure includes a substrate, an elastic layer on the substrate, and a surface layer on the elastic layer, the surface layer containing a fluorine resin.

In addition, the surface layer has a surface resistivity of $1\times10^{11}$[Ω/□] or less at a temperature of 25° C. when applying a DC voltage of 500 V, and a thermal conductivity λ in a thickness direction of the surface layer is 0.093 [W/(m·K)] or less.

Details about the present disclosure are described below with reference to the drawings.

1. Pressurizing Member

Figure 3:
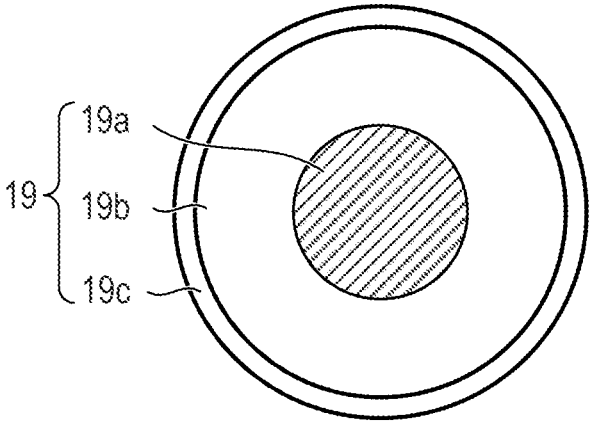
FIG. 3 is a schematic sectional view of the pressurizing member that is an example of the present disclosure.

FIG. 3 is a sectional view of a roller-shaped pressurizing member (hereinafter also referred to as "pressurizing roller") 19 according to one aspect of the present disclosure in its peripheral direction. The pressurizing roller 19 includes: a columnar substrate 19*a*; and an elastic layer 19*b* formed on the outer peripheral surface of the substrate 19*a* so as to be concentric with the substrate 19*a* and to be a cylindrical shape. The outer peripheral surface of the elastic layer 19*b* is covered with a surface layer 19*c* serving as an outermost layer. The elastic layer 19*b* may be bonded to the outer peripheral surface of the substrate 19*a* with an adhesion layer (not shown), and the surface layer 19*c* may be bonded to the outer peripheral surface of the elastic layer 19*b* with an adhesion layer (not shown).

1-1. Substrate

A substrate made of iron or aluminum is suitably used as the substrate 19*a*, and its surface may be degreased with, for example, methylene chloride, a hydrocarbon-based detergent, or a water-based detergent after having been activated by sandblasting or the like in advance.

1-2. Elastic Layer

The elastic layer 19*b* is a layer for forming a fixing nip portion N to be described later in the section "2. Fixing Device," and may be a solid rubber layer or a foamed rubber layer. Although the thickness of the elastic layer 19*b* to be used in the pressurizing member 19 is not particularly limited as long as the thickness enables the formation of the fixing nip portion N having a desired width, the thickness is preferably from 2 mm to 10 mm.

Any one of the following polymers is suitably used as the main polymer of the elastic layer 19*b*. Examples thereof include a high temperature vulcanizing silicone rubber (HTV; High Temperature Vulcanizing), an addition reaction curable silicone rubber (LTV; Low Temperature Vulcanizing), a condensation reaction curable silicone rubber (RTV; Room Temperature Vulcanizing), a fluorine rubber, and mixtures thereof. Specifically, for example, a silicone rubber, such as a dimethyl silicone rubber, a fluorosilicone rubber, a methylphenyl silicone rubber, or a vinyl silicone rubber, or a fluorine rubber, such as a vinylidene fluoride rubber, a tetrafluoroethylene-propylene rubber, a tetrafluoroethylene-perfluoromethyl vinyl ether rubber, a phosphazene-based fluorine rubber, or a fluoropolyether, may be used. Those main polymers may be used alone or in combination thereof. Reinforcing fillers, such as carbon black, and wet silica and dry silica, and extender fillers, such as calcium carbonate and quartz powder, may each be added to the main polymer.

1-3. Surface Layer

The thermal conductivity λ of the surface layer 19*c* in its thickness direction is 0.093 [W/(m·K)] or less. Thus, heat conduction from the heating member to the pressurizing member in a fixing step can be suppressed. Further, the surface resistivity of the surface layer at a temperature of 25° C. when applying a DC voltage of 500 V, the surface resistivity being measured on its outer surface, is $1\times10^{11}$ [Ω/□] or less. Thus, there can be obtained such a pressurizing member that its outer surface is hardly charged even by its sliding with the heating member, and hence an electrostatic offset can be significantly suppressed.

Figure 1:
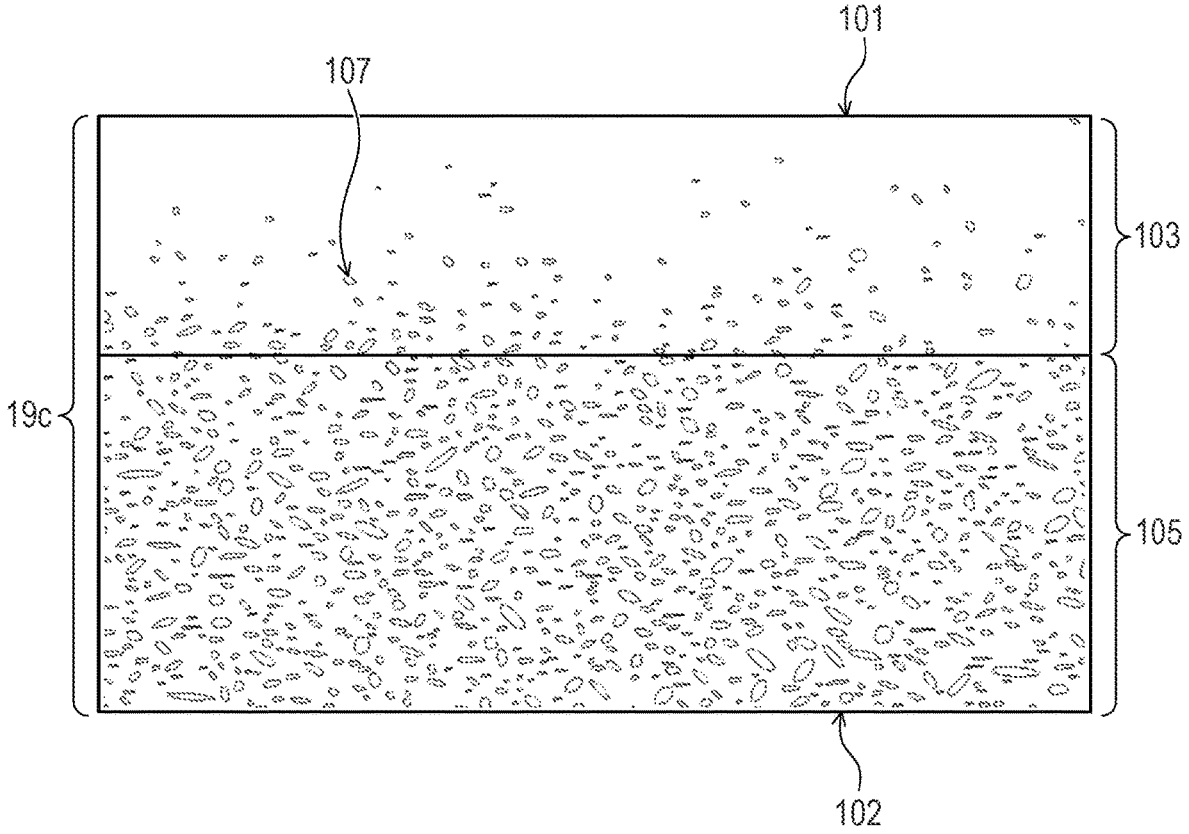
FIG. 1 is a schematic sectional view of the surface layer of a pressurizing member according to one aspect of the present disclosure in its thickness direction.

The surface layer satisfying such physical properties may be formed from, for example, a fluorine resin layer having pores. FIG. 1 is a schematic view of a cross section of the surface layer in a thickness-direction section when cutting the surface layer in a direction perpendicular to the peripheral direction, i.e. a direction in parallel to a longitudinal direction, of the pressurizing roller according to one aspect of the present disclosure. As illustrated in FIG. 1, a region from the outer surface 101 of the surface layer 19*c* for forming the outer surface of the pressurizing roller to a position distant therefrom by 5 μm in a depth direction is defined as a "region A" 103, and a region from the position distant from the outer surface 101 by 5 μm in the depth direction to a surface 102 opposite to the outer surface 101 is defined as a "region B" 105. In addition, when a square observation region 5 μm on a side (hereinafter also referred to as "first observation region") is put at an arbitrary position in the region A in the cross section, the ratio of the total sum of the areas of pores 107 observed in the first observation region to the area of the first observation region is defined as a porosity ΦA (%). In addition, when a square observation region 10 μm on a side (hereinafter also referred to as "second observation region") is set at a predetermined position of the region B in the section, the ratio of the total sum of the areas of the pores observed in the second observation region to the area of the second observation region is defined as a porosity ΦB (%). In addition, when a relationship of ΦA<ΦB is satisfied, the thermal conductivity of the surface layer in its thickness direction can be reduced without any increase in surface resistivity of the outer surface 101. It is preferred that the porosity ΦA be 0% or more and 13% or less, and the porosity ΦB of the region B on a side closer to the elastic layer with respect to the region A be 28% or more and 50% or less.

Such configuration may be achieved with, for example, a surface layer constituted by a single-layer which is formed so that its porosity may increase from the outer surface 101 toward the surface 102. In addition, the configuration may be achieved with a surface layer constituted by laminate including two layers such as a fluorine resin layer for forming the region A and a fluorine resin layer for forming the region B. However, the surface layer 19*c* is preferably formed from a single-layer which is free of any interface in the surface layer. A method including the following steps (i) to (v) is given as a nonlimitative example of a method of producing a pressurizing roller including such single-layer film as its surface layer:

(i) a step of obtaining a laminate in which the outer peripheral surface of the elastic layer formed on a base layer is covered with a fluorine resin tube containing an electroconductive material such as carbon black;

(ii) a step of immersing the laminate in the bath of a perfluoropolyether (hereinafter referred to as "PFPE") heated to the vicinity of the melting point of the fluorine resin, for example, 300° C.±50° C., preferably from 290° C. to 325° C. when the fluorine resin is a PFA, followed by its standing for preferably from 20 seconds to 5 minutes, more preferably from 30 seconds to 2 minutes to impregnate the PFPE from the outer surface of the fluorine resin tube opposite to its side facing the elastic layer into the fluorine resin tube;

(iii) a step of removing the laminate in which the PFPE has been impregnated into the fluorine resin tube through the step (ii) from the bath, followed by its cooling to room temperature, for example, from 20° C. to 35° C., preferably from 25° C. to 30° C.;

(iv) a step of immersing the laminated film obtained through the step (iii) in a solvent that can dissolve the PFPE to remove the PFPE impregnated into the PFA tube from the outer surface of the fluorine resin tube, to thereby form pores opening in the outer surface of the fluorine resin tube and extending in the fluorine resin tube in its thickness direction; and (v) a step of rolling the laminate obtained through the step (iv) on a metal plate heated to a predetermined temperature (e.g., 200° C.) to crush the pores near the outer surface of the fluorine resin tube, to thereby form the surface layer having the region A and the region B.

The inventors have assumed the reason why the pressurizing roller including the surface layer according to one aspect of the present disclosure is obtained by the method including the above-mentioned steps (i) to (v) to be as described below. First, in the step (ii), when the outer surface of the fluorine resin tube is brought into contact with the PFPE at a temperature near the melting point of the fluorine resin in the resin layer (e.g., a temperature of 300° C.±50° C. (preferably from 290° C. to 325° C.) when the fluorine resin is a PFA), the PFPE is impregnated into the fluorine resin tube. Next, in the step (iii), the resin layer is cooled to room temperature, and in the process, the fluorine resin tube that has expanded in the step (ii) contracts. Along with the contraction, the PFPE near the outer surface of the fluorine resin tube is discharged to the outside of the fluorine resin tube. Meanwhile, the PFPE that has permeated from the outer surface of the fluorine resin tube and has permeated up to an inside distant from the outer surface of the fluorine resin tube is not discharged even by the contraction of the fluorine resin tube along with its cooling, but remains in the fluorine resin tube. Next, as a result of the removal of the PFPE from the resin layer with the solvent to be performed in the step (iv), the pores opening in the first surface of the resin layer are formed in sites where the PFPE has been present. Because of the foregoing reason, a porous fluorine resin tube having a high porosity is formed not so much on the outer surface side of the fluorine resin tube as on the side opposite to the outer surface, that is, the side closer to the elastic layer. Further, in the step (v), when the outer surface of the porosified fluorine resin tube is pressurized under heating, the pores near the outer surface of the fluorine resin tube are crushed. Thus, the region A having a small number of the pores and the region B having a large number of the pores can be formed in the fluorine resin tube that is a single layer.

The amount of the PFPE impregnated into the fluorine resin tube in the step (ii) may be adjusted by, for example, the temperature and viscosity of the PFPE, and the time period for which the fluorine resin tube and the PFPE are brought into contact with each other at the time of the impregnation. Specifically, as the temperature becomes higher in a temperature range near the melting point of the fluorine resin (a temperature of from 250° C. to 350° C. when the fluorine resin is a PFA), as the viscosity of the PFPE becomes lower, and as the contact time becomes longer, the amount of the PFPE impregnated into the fluorine resin tube can be increased. Herein, the viscosity of the PFPE is preferably from 10 mPa·s to 400 mPa·s, more preferably from 30 mPa·s to 350 mPa·s. As a commercial PFPE having such viscosity range, there are given: "Krytox GPL-101" (viscosity: 12 mPa·s); "Krytox GPL-102" (viscosity: 26 mPa·s); "Krytox GPL-103" (viscosity: 54 mPa·s); "Krytox GPL-104" (viscosity: 111 mPa·s); "Fomblin M03" (viscosity: 30 mPa·s); and "Krytox GPL-105" (viscosity: 301 mPa·s).

In the step (iv), to remove the PFPE impregnated into the fluorine resin tube, the laminated film obtained through the step (iii) is immersed in the solvent that can dissolve the PFPE and does not dissolve the fluorine resin so that the surface of the fluorine resin tube may be wet. The term "solvent that dissolves the PFPE" as used herein refers to, for example, such a solvent that the amount of the PFPE dissolved in 100 g of the solvent is 10 g or more at a temperature of 25° C. Meanwhile, the term "solvent that does not dissolve the fluorine resin" refers to, for example, such a solvent that the amount of the fluorine resin dissolved in 100 g of the solvent is 1 g or less at 25° C. When the fluorine resin is a PFA, for example, a hydrofluoroether (product name: Novec 7600; manufactured by 3M Company) may be used as the solvent. In addition, at the time of the removal of the PFPE from the fluorine resin tube in the step (iv), the application of an ultrasonic wave to the fluorine resin tube is preferred for accelerating the removal of the PFPE from the fluorine resin tube.

In the above-mentioned steps (ii) to (iv), after the formation of the laminate in which the top of the elastic layer was covered with the fluorine resin tube, the fluorine resin tube was porosified. However, a method of forming the surface layer according to the present disclosure is not limited thereto. The surface layer according to the present disclosure may also be formed by, for example, a method including: impregnating the PFPE into the fluorine resin tube alone as described above; removing the impregnated PFPE to porosify the tube; and bonding and fixing the porosified fluorine resin tube onto the elastic layer. When the PFPE is impregnated into the fluorine resin tube by immersing the fluorine resin tube in the PFPE, the inner peripheral surface of the fluorine resin tube is preferably subjected to masking prior to the immersion of the fluorine resin tube in the PFPE so that the impregnation of the PFPE from the inner peripheral surface of the fluorine resin tube may not occur.

The step (v) is treatment in which the pores near the outer surface 101 of the porosified fluorine resin tube are crushed to reduce the surface resistivity on the outer surface of the surface layer. According to an investigation by the inventors, as the temperature of the metal plate is increased, a larger number of the pores near the outer surface can be crushed. Herein, the temperature of the metal plate and the time period for which the laminate whose surface layer has been porosified is treated by being forcedly pressed against the metal plate only need to be appropriately selected as long as the pores can be crushed so that the surface resistivity measured on the outer surface of the surface layer may satisfy the value according to the present disclosure. In addition, a method of crushing the pores near the outer surface is not limited thereto, and may also be, for example, a method including applying warm air to the outer surface to heat the outer surface side of the surface layer.

<Fluorine Resin>

Examples of the fluorine resin that is a constituent material for the surface layer include a PFA, polytetrafluoroethylene (hereinafter referred to as "PTFE"), and a copolymer (hereinafter referred to as "FEP") of tetrafluoroethylene and hexafluoropropylene. Of those, a PFA may be more suitably used because the PFA can form a surface layer including an outer surface showing high releasability to toner or the like, and can be efficiently porosified by the above-mentioned impregnation including using the PFPE and the removal thereof.

Herein, as described above, the PFA is a copolymer of a perfluoroalkyl vinyl ether (hereinafter referred to as "PAVE") and tetrafluoroethylene (hereinafter referred to as "TFE"). The number of carbon atoms in the perfluoroalkyl chain of the PAVE is preferably from 1 to 6, more preferably from 1 to 4, still more preferably from 1 to 3. The PAVE is preferably selected from perfluoromethyl vinyl ether ($CF_2{=}CF{-}O{-}CF_3$), perfluoroethyl vinyl ether ($CF_2{=}CF{-}O{-}CF_2CF_3$), and perfluoropropyl vinyl ether ($CF_2{=}CF{-}O{-}CF_2CF_2CF_3$). The melting point of the PFA is preferably from 280° C. to 320° C., more preferably from 290° C. to 310° C.

A commercial product may be used as the PFA, and specific examples thereof are given below:

"451HP-J", "959HP-Plus", "350-J", and "950HP-Plus" (each of which is a product name, manufactured by Chemours-Mitsui Fluoroproducts Co., Ltd.);

"P-66P", "P-66PT", and "P-802UP" (each of which is a product name, manufactured by AGC Inc.);

"AP-230", "AP-231SH", and the like (each of which is a product name, manufactured by Daikin Industries, Ltd.); and "6502N" (product name, manufactured by 3M Company).

<Perfluoropolyether (PFPE)>

The PFPE has a perfluoropolyether structure. Specifically, for example, the PFPE has a structure represented by the following structural formula (1).

$$F{-}(CF_2{-}O)_a(CF_2{-}CF_2{-}O)_b(CF_2{-}CF_2{-}CF_2{-}O)_c\left(\overset{\overset{CF_3}{|}}{CF}{-}CF_2{-}O\right)_d\left(\overset{\overset{CF_3}{|}}{CF}\right)_e(CF_2)_f{-}CF_3$$

(In the structural formula (1), "a", "b", "c", "d", "e", and "f" each independently represent 0 or a positive integer, and satisfy $1 \leq a+b+c+d+e+f \leq 600$, and at least one of "a", "b", "c", or "d" represents a positive integer.)

In addition, the order in which the respective repeating units in the structural formula (1) are present is not limited to the order represented in the structural formula (1). Further, each repeating unit may be present at a plurality of sites in the PFPE represented by the structural formula (1). That is, the PFPE represented by the structural formula (1) may be a block copolymer, or may be a random copolymer.

A commercial product may be used as the PFPE, but a PFPE that is in an oil state at the melting point of the fluorine resin is more suitably used. When the fluorine resin is the PFA, specifically, "Krytox GPL103", "Krytox GPL104", and "Krytox GPL105" (each of which is a product name, manufactured by The Chemours Company), or the like may each be used as a PFPE having a structure represented by the above-mentioned structural formula.

The thickness of the surface layer is not particularly limited. In typical cases, however, the thickness is preferably 12 μm or more and 100 μm or less, particularly preferably 20 μm or more and 85 μm or less.

2. Fixing Device

Figure 4:
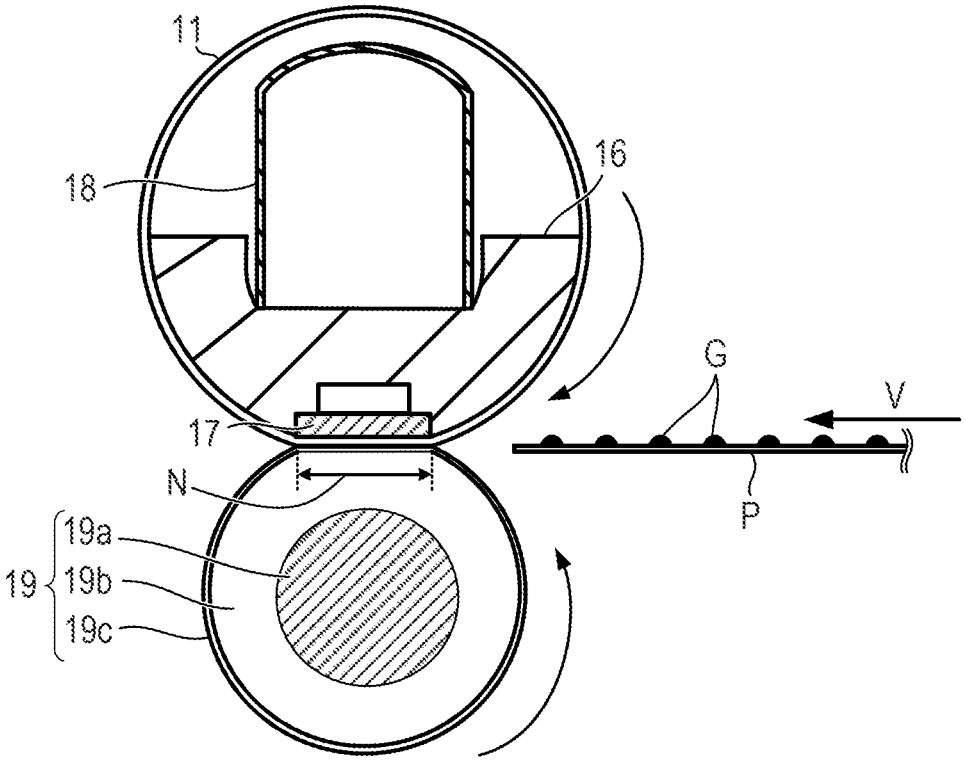
FIG. 4 is a schematic sectional view of a fixing device using the pressurizing member according to the present disclosure.

FIG. 4 is a schematic view for illustrating a section of an example of the schematic configuration of a fixing device of a belt heating system.

A fixing belt 11 is loosely fit onto a belt guide member 16. A rigid stay 18 for pressurization is inserted into the inside of the belt guide member 16. The belt guide member 16 is formed of, for example, a resin having heat resistance and a heat-insulating property.

The heat-fixing apparatus includes a ceramic heater 17 serving as a heat source at the position at which the belt guide member 16 and the inner surface of the fixing belt 11 are brought into contact with each other. The ceramic heater 17 is fixed by being fit into a groove portion arranged along the longitudinal direction of the belt guide member 16. The ceramic heater 17 is energized by a unit (not shown) to generate heat.

A roller-shaped pressurizing member 19 is a pressurizing member according to one aspect of the present disclosure. A pressurizing spring (not shown) is arranged under a contracted state between each of both end portions of the rigid stay 18 for pressurization and a spring-receiving member (not shown) on an apparatus chassis side. Thus, a depressing force is applied to the rigid stay 18 for pressurization to bring the lower surface of the ceramic heater 17 arranged on the lower surface of the belt guide member 16 and the upper surface of the pressurizing member 19 into press contact with each other with the fixing belt 11 sandwiched therebetween, to thereby form a predetermined fixing nip portion N. That is, the lower surface of the ceramic heater 17 is arranged so as to be brought into contact with the inner peripheral surface of the fixing belt 11.

A recording medium P serving as a body to be heated, on which images have been formed with an unfixed toner G, is conveyed to the fixing nip portion N at a conveying velocity V so as to be sandwiched between the fixing belt and the pressurizing member. Thus, the toner images are heated and pressurized. As a result, the toner images are melted and subjected to color mixing. After that, when the toner images are cooled, the toner images are fixed onto the recording medium P.

Herein, also in a system except the belt heating system like this example, for example, a heat roller system, the same effect can be obtained by adopting a configuration including the pressurizing member according to the present disclosure.

3. Image-Forming Apparatus

An image-forming apparatus is, for example, a multifunction machine, a copying machine, a facsimile, or a printer using an electrophotographic system. Herein, the overall configuration of the image-forming apparatus is schematically described by using a color laser printer as an example.

Figure 5:
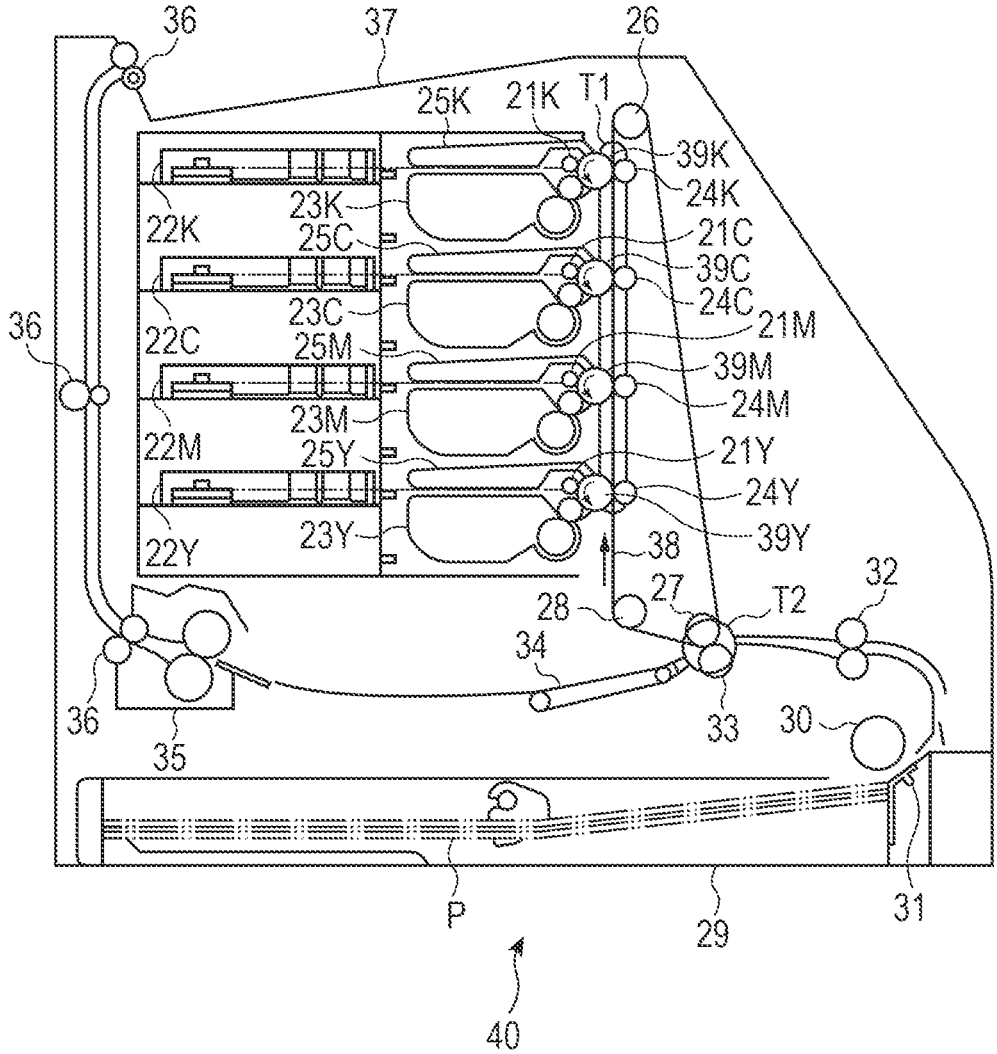
FIG. 5 is a schematic view for illustrating an electrophotographic image-forming apparatus according to one aspect of the present disclosure.

FIG. 5 is a schematic sectional view of a laser printer 40 according to one aspect of the present disclosure. The laser printer 40 illustrated in FIG. 5 includes, for each of yellow (Y), magenta (M), cyan (C), and black (K) colors, an image-forming portion including an electrophotographic photosensitive drum 39 (hereinafter referred to as "photosensitive drum 39") configured to rotate at a constant speed. In addition, the laser printer includes an intermediate transfer member 38 configured to hold color images, which have been developed in the image-forming portions and transferred in a multiple manner, and to further transfer the images onto the recording medium P fed from a feeding portion.

The photosensitive drums 39 (39Y, 39M, 39C, and 39K) are each rotationally driven counterclockwise by a driving unit (not shown) as illustrated in FIG. 5.

A charging apparatus 21 (21Y, 21M, 21C, or 21K) configured to uniformly charge the surface of each of the photosensitive drums 39, a scanner unit 22 (22Y, 22M, 22C, or 22K) configured to irradiate the photosensitive drum 39 with laser beam based on image information to form an electrostatic latent image thereon, a developing unit 23 (23Y, 23M, 23C, or 23K) configured to cause toner to adhere to the electrostatic latent image to develop the image as a toner image, a primary transfer roller 24 (24Y, 24M, 24C, or 24K) configured to transfer the toner image on the photosensitive drum 39 onto the intermediate transfer member 38 in a primary transfer portion T1, and a cleaning unit 25 (25Y, 25M, 25C, or 25K) including a cleaning blade configured to remove transfer residual toner remaining on the surface of the photosensitive drum 39 after the transfer are sequentially arranged around the photosensitive drum 39 in accordance with its rotation direction.

At the time of image formation, the intermediate transfer member 38 having a belt shape, which is suspended over rollers 26, 27, and 28, rotates, and the toner images of the respective colors formed on the respective photosensitive drums 39 are primarily transferred onto the intermediate transfer member 38 in a superimposed manner. Thus, a color image is formed.

In synchronization with the primary transfer onto the intermediate transfer member 38, the recording medium P is conveyed to a secondary transfer portion T2 by a conveying unit. The conveying unit includes: a feeding cassette 29 storing the plurality of recording media P; a feeding roller 30; a separating pad 31; and a registration roller pair 32. At the time of the image formation, the feeding roller 30 is driven to rotate in accordance with an image-forming operation to separate the recording media P in the feeding cassette 29 one by one, and the separated recording medium is conveyed to the secondary transfer portion T2 by the registration roller pair 32 in timing with the image-forming operation.

A secondary transfer roller 33 that can move is arranged in the secondary transfer portion T2. The secondary transfer roller 33 can move in a substantially vertical direction. In addition, at the time of image transfer, the secondary transfer roller 33 is pressed against the intermediate transfer member 38 at a predetermined pressure through the recording medium P. At the same time, a bias is applied to the secondary transfer roller 33, and hence the toner image on the intermediate transfer member 38 is transferred onto the recording medium P.

The intermediate transfer member 38 and the secondary transfer roller 33 are each driven, and hence the recording medium P in a state of being sandwiched therebetween is conveyed in a left arrow direction illustrated in FIG. 5 at the predetermined conveying velocity V. Further, the recording medium is conveyed to a fixing portion 35 serving as the next step by a conveying belt 34. In the fixing portion 35, heat and a pressure are applied to fix the transferred toner image onto the recording medium P. The recording medium P is discharged onto a discharge tray 37 on the upper surface of the apparatus by discharge roller pairs 36.

According to one aspect of the present disclosure, there can be obtained the pressurizing member for electrophotography, which is reduced in thermal conductivity in its thickness direction while being suppressed in increase in resistance of its outer surface. In addition, according to another aspect of the present disclosure, there can be obtained the fixing device, which can further shorten a first print time and more satisfactorily prevent the occurrence of an electrostatic offset. In addition, according to still another aspect of the present disclosure, there can be obtained the electrophotographic image-forming apparatus, which has a further shortened first print time and can stably form a high-quality electrophotographic image.

EXAMPLES

Now, the present disclosure is specifically described by way of Examples. However, the present disclosure is not limited to Examples described below.

Example 1

(Production of Laminate)

First, a PFA (product name: 959HP-Plus, manufactured by Chemours-Mitsui Fluoroproducts Co., Ltd.) and carbon black (product name: KETJENBLACK EC300J, manufactured by Lion Specialty Chemicals Co., Ltd.) were melted and kneaded together, and the kneaded product was extrusion-molded into a cylindrical shape to produce a PFA tube having a thickness of 20 μm and a surface resistivity measured on its outer surface of $1\times10^7$[Ω/□]. The PFA had a melting point of 296° C.

Next, a mixture containing equal amounts of the "liquid A" and "liquid B" of a primer for an addition-curable liquid conductive silicone rubber (product name: SILASTIC DY 35-051 A&B; manufactured by Dow Toray Co., Ltd.) was applied as an adhesion layer to the outer periphery of a 23-millimeter diameter iron shaft core whose surface had been subjected to sandblasting treatment with a spray, and was baked at a temperature of 150° C. for 30 minutes.

Next, 50 parts of the liquid A (main agent) of an addition-type liquid silicone rubber (product name: SILASTIC DY 35-1349 SC, manufactured by Dow Toray Co., Ltd.; product having a volume resistivity of $10^5$ Ω·cm) and 50 parts of the liquid B (curing agent) thereof were cast into a molding mold having a cavity having an inner diameter of 30 mm, the cavity being mounted with an iron shaft core at its center, and were primarily vulcanized at 150° C. for 1 hour, followed by removal from the mold. Thus, an elastic layer was formed on the peripheral surface of the shaft core. Next, a product obtained by adding 0.5 part of potassium pentafluoroethanesulfonate ($C_2F_5SO_3K$) to 100 parts of a mixture containing equal amounts of the "liquid A" and "liquid B" of an addition-curable silicone rubber adhesive (product name: DOWSIL SE 1819 CV, manufactured by Dow Toray Co., Ltd.) was applied to the outer peripheral surface of the elastic layer so as to have a thickness of 5 μm. Then, the top of the adhesive was covered with the PFA tube produced in advance. Then, the shaft core having laminated thereon the elastic layer and the PFA tube was loaded into an electric furnace set at a temperature of 200° C., and was heated for 4 hours so that the adhesive was cured. Thus, a laminate was obtained.

(Production of Pressurizing Member)

(Impregnation)

PFPE (product name: Krytox GPL104, manufactured by The Chemours Company, viscosity: 111 mPa·s (40° C.)) was loaded into a measuring cylinder made of borosilicate glass, and the PFPE was heated to 300° C. The laminate produced in the foregoing was immersed in the PFPE at 300° C. for 1 minute, and was then removed and left to stand until its temperature became room temperature (a temperature of 25° C.).

(Pore Formation)

Next, a separately prepared fluorine solvent (product name: Novec 7300, manufactured by 3M Company) was loaded into a measuring cylinder, and the laminate left to stand until its temperature became room temperature was immersed therein for 10 minutes. Next, the measuring cylinder was loaded into the water tank of an ultrasonic cleaning device (product name: BRANSONIC (model: 2510J-DTH), manufactured by Emerson Japan, Ltd.) while the laminate was loaded into the cylinder, followed by the application of an ultrasonic wave thereto for 60 minutes. After that, the laminate was removed from the measuring cylinder, and was dried under an environment having a temperature of 25° C. for 60 minutes. The surface layer of the resultant laminate was opaque when visually observed, and hence it was able to be recognized that pores were formed in the PFA tube.

(Heating Compression)

Figure 2:
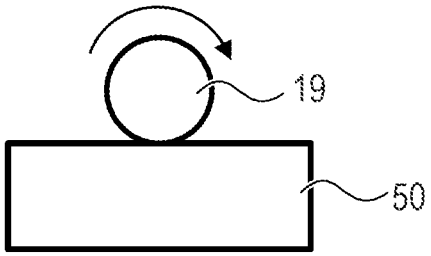
FIG. 2 is a schematic view of a step of crushing a pore near the surface layer described in Examples.

Next, as illustrated in FIG. 2, the laminate was rotated on a metal plate 50 heated to a temperature of 200° C. at a peripheral speed of 90 mm/s for 1 second so that the PFA tube was compressed from its outer surface. Thus, a pressurizing roller 1 according to this Example was obtained.

<Evaluation>

The resultant pressurizing roller 1 was subjected to the following evaluation 1 to evaluation 5.

(Preparation of Measurement Sample)

A laminate for evaluation of the elastic layer and the surface layer was cut out of the pressurizing roller 1. Next, the laminate for evaluation was immersed in a silicone resin-dissolving agent (product name: e SOLVE 21RS, manufactured by Kaneko Chemical Co., Ltd.) so that the silicone rubber in the elastic layer was dissolved. Thus, the elastic layer was removed from the laminate for evaluation. Thus, a measurement sample including the total thickness portion of the surface layer formed of the PFA tube was obtained.

(Evaluation 1: Thermal Conductivity of Surface Layer in its Thickness Direction)

The thermal conductivity $\lambda$ of the surface layer in its thickness direction was calculated from the following equation:

$$\lambda=\alpha\times C_p\times\rho$$

where $\lambda$ represents the thermal conductivity (W/(m·K)) of the surface layer in the thickness direction, a represents the thermal diffusivity ($m^2/s$) thereof in the thickness direction, $C_p$ represents the specific heat (J/(kg·K)) thereof at constant pressure, and $\rho$ represents the density ($kg/m^3$) thereof. Herein, the values of the thermal diffusivity $\alpha$ in the thickness direction, the specific heat $C_p$ at constant pressure, and the density $\rho$ were determined by the following methods.

(Thermal Diffusivity $\alpha$)

The thermal diffusivity $\alpha$ of the surface layer in the thickness direction was measured with a periodic heating method-thermophysical property-measuring device (product name: FTC-1, manufactured by ADVANCE RIKO, Inc.) at room temperature (25° C.). A sample piece having an area of 8 mm by 12 mm was cut out of the measurement sample with a cutter, and a total of 5 sample pieces were produced, followed by the measurement of the thicknesses of the respective sample pieces with a digital length-measuring machine (product name: DIGIMICRO MF-501, flat probe: φ4 mm, manufactured by Nikon Corporation). Next, the thermal diffusivity of each of the sample pieces was measured a total of 5 times, and the average ($m^2/s$) of the measured values was determined. The measurement was performed while the sample piece was pressurized with a weight of 1 kg.

(Specific Heat $C_p$ at Constant Pressure)

The specific heat of the surface layer at constant pressure was measured with a differential scanning calorimeter (product name: DSC823e, manufactured by Mettler-Toledo International Inc.).

Specifically, aluminum pans were used as a pan for a sample and a pan for reference. First, as blank measurement, the measurement of the specific heat of air was performed by the following program: under a state in which both the pans were empty, a temperature in each of the pans was kept at a constant temperature of 15° C. for 10 minutes, was then increased to 215° C. at a rate of temperature increase of 10° C./min, and was further kept at a constant temperature of 215° C. for 10 minutes. Next, specific heat measurement was performed by the same program through use of 10 mg of synthesized sapphire whose specific heat at constant pressure was known as a reference substance. Next, 10 mg of a measurement sample identical in amount to the synthesized sapphire serving as the reference substance was cut out of the measurement sample, and was then set in the sample pan, followed by the measurement of its specific heat by the same program 5 times. Those measurement results were analyzed with specific heat analysis software attached to the differential scanning calorimeter, and the specific heat $C_p$ at constant pressure at 25° C. was calculated from the average of the 5 measurement results.

(Density $\rho$)

The density of the surface layer was measured with a dry automatic densimeter (product name: AccuPyc 1330-01, manufactured by Shimadzu Corporation).

Specifically, a sample cell having a volume of 10 $cm^3$ was used, and a sample piece was cut out of the measurement sample so as to fill about 80% of the cell volume, followed by the measurement of the mass of the sample piece. After that, the sample piece was loaded into the sample cell. The sample cell was set in a measuring portion in the densimeter, and helium was used as a gas for measurement to replace air in the cell with the gas. After that, the volume of the sample piece was measured 10 times. The density of the surface layer was calculated from the mass of the sample piece and the measured volume for each time of the measurement, and the average of the calculated values was determined.

Finally, the thermal conductivity $\lambda$ of the surface layer in the thickness direction was calculated from the specific heat $C_p$ (J/(kg·K)) of the surface layer at constant pressure and the density $\rho$ ($kg/m^3$) thereof subjected to unit conversion, and the measured thermal diffusivity $\alpha$ ($m^2/s$).

(Evaluation 2: Evaluation of Surface Resistivity)

The thickness of the surface layer was measured with a micrometer. In addition, the surface resistivity of the surface layer was measured by a method in conformity with JIS K 6911. Specifically, the UR-SS probe of Hiresta-UX MCP-HT800 manufactured by Nittoseiko Analytech Co., Ltd. was brought into contact with each sample to measure its surface resistivity. At the time of the measurement, a DC voltage of 500 V was applied to the sample, and a value obtained by the measurement after the application for 20 seconds was adopted as a surface resistivity.

(Evaluation 3: Evaluation of Start Time)

The pressurizing roller 1 was mounted on the fixing device of an electrophotographic image-forming apparatus (product name: imageRUNNER-ADVANCE C5051; manufactured by Canon Inc.). A pressurizing force acting between the fixing belt of the fixing device and the pressurizing roller was set to 20 Kgf. Then, the ceramic heater of the fixing device was energized at 1,200 W, and a time period required for the surface temperature of the fixing belt to reach 200° C. that was its fixable temperature was measured and adopted as a start time. The start time was evaluated by the following criteria.

(Evaluation Criteria)

Rank A: less than 7.5 seconds

Rank B: 7.5 seconds or more and 8.5 seconds or less

Rank C: 8.5 seconds or more (Evaluation 4: Evaluation of Electrostatic Offset)

A heat fixing device illustrated in FIG. 4 was assembled by using the pressurizing roller 1, and paper having formed thereon an unfixed toner image was passed therethrough so that the image was fixed. Thus, an electrophotographic image was formed. As conditions for the fixation, 300 sheets of the paper were continuously passed at a fixation temperature of 160° C. and a paper passing speed of 50 mm/sec, and then the electrophotographic image on the 300th sheet was visually observed, followed by the evaluation of the presence or absence of an electrostatic offset by the following criteria.

(Evaluation Criteria)

Rank A: None of a toner offset and toner missing occurs.

Rank B: A toner offset and toner missing are slightly observed.

Rank C: Both of a toner offset and toner missing are observed.

(Evaluation 5: Calculation of Porosity of Surface Layer)

The porosity ΦA of the region A of the surface layer of the pressurizing roller 1 and the porosity ΦB of the region B thereof were calculated as described below.

A section in a thickness direction parallel to a direction perpendicular to the peripheral direction of the pressurizing roller 1 was cut out of the pressurizing roller with a cryoultramicrotome (manufactured by Leica Microsystems GmbH). The surface of the resultant section sample corresponding to a section of the surface layer was observed with a scanning electron microscope, and a SEM image of the section (magnification: 10,000) was obtained. The positions at which the SEM images were obtained were defined as described below with respect to the thickness direction of the surface layer of the section:

(1) a first observation region of a square shape measuring 5 μm long by 5 μm wide was set in a 5-micrometer region ranging from the outer surface side of the surface layer of the section toward the opposite surface thereof so that the upper end of the first observation region coincided with the outer surface and the upper end of the first observation region was parallel to the outer surface; and (2) a second observation region of a square shape measuring 10 μm long by 10 μm wide was set in a 10-micrometer region ranging from the surface of the surface layer of the section opposite to the outer surface toward the outer surface so that the lower end of the second observation region coincided with the surface opposite to the outer surface and the lower end of the second observation region was parallel to the surface opposite to the outer surface.

The resolution of each of the SEM images was set to 717 pixels long by 986 pixels wide so that the pores of the section were able to be observed in the SEM image. The horizontal direction of each of the observation regions was made parallel to the first surface of the PFA tube. The SEM images were each subjected to binarization treatment with numerical calculation software (product name: MATLAB (trademark); manufactured by The MathWorks, Inc.) to provide a binarized image. Otsu's method was used in the binarization treatment to distinguish portions corresponding to the pores in each of the SEM images and a portion corresponding to the PFA therein.

Then, the ratio of the number of pixels of the portions corresponding to the pores in the resultant binarized image to the total number of pixels was determined.

Examples 2 to 9

Pressurizing rollers 2 to 9 were each produced in the same manner as in Example 1 except that at least one of the thickness of the PFA tube to be used in the surface layer, the temperature of the PFPE in which the laminate was immersed, or the temperature of the metal plate at the time of the heating compression of the outer surface of the porosified PFA tube was changed as shown in Table 1.

Example 10

A laminate before its covering with a PFA tube was produced in the same manner as in Example 1. Next, the following paint 1 was applied to the outer surface of the adhesion layer formed on the elastic layer, and was baked to form a porous PFA film having a thickness of 20 μm. A product obtained by mixing 100 parts by mass of a PFA paint (perfluoroethylene-propylene copolymer; "EM-560CL" manufactured by Dupont-Mitsui Fluorochemicals Co., Ltd.) with 65 parts by mass of hollow particles (product name: 3M Glass Bubbles iM30K, manufactured by 3M Company) was used as the paint 1. Next, the following paint 2 was applied onto the outer peripheral surface of the porous PFA film, and was baked to form a solid PFA film having a thickness of 20 μm. A PFA paint (perfluoroethylene-propylene copolymer; "EM-560CL" manufactured by Dupont-Mitsui Fluorochemicals Co., Ltd.) was used as the paint 2. Thus, a pressurizing roller 10 including a surface layer formed of the two PFA films was obtained.

Comparative Example 1

The laminate produced in Example 1 was adopted as a pressurizing roller A-1 according to Comparative Example 1 herein.

Comparative Examples 2 to 4

Rollers each obtained by changing the thickness of the surface layer (PFA tube) of the pressurizing roller A-1 according to Comparative Example 1 as shown in Table 1 were adopted as pressurizing rollers A-2 to A-4 according to Comparative Examples 2 to 4.

Comparative Examples 5 and 6

The thickness of the PFA tube to be used in the surface layer, the temperature of the PFPE in which the laminate was immersed, and the temperature of the metal plate at the time of the heating compression of the outer surface of the porosified PFA tube were set as shown in Table 1. Pressurizing rollers B-1 and B-2 were each produced in the same manner as in Example 1 except the foregoing.

Comparative Example 7

A laminate before its covering with a PFA tube was produced in the same manner as in Example 1. Next, the following paint 1 was applied to the outer surface of the adhesion layer formed on the elastic layer, and was baked to form a porous PFA film having a thickness of 20 μm. A product obtained by mixing 100 parts by mass of a PFA paint (perfluoroethylene-propylene copolymer; "EM-560CL" manufactured by Dupont-Mitsui Fluorochemicals Co., Ltd.) with 65 parts by mass of hollow particles (product name: 3M Glass Bubbles iM30K, manufactured by 3M Company) was used as the paint 1. Thus, a pressurizing roller C including a surface layer formed of the one porous PFA film was produced.

Comparative Example 8

A pressurizing roller D was produced in the same manner as in Example 1 except that in a production process for the pressurizing roller 1 according to Example 1, the heating compression of the outer surface of the porosified PFA tube was not performed.

The pressurizing rollers 1 to 10 according to Examples 1 to 10, and the pressurizing rollers A-1 to A-4, B-1 and B-2, C, and D according to Comparative Examples 1 to 8 produced in the foregoing were subjected to the evaluation 1 to the evaluation 5. The evaluation results are shown in Table 1 and Table 2.

TABLE 1

| | Sample name | PFA thickness [μm] | Temperature at which laminate is brought into contact with PFPE [° C.] | Temperature of metal plate [° C.] | Porosity ΦA of region A [%] | Porosity ΦB of region B [%] |
|---|---|---|---|---|---|---|
| Example 1 | Pressurizing member 1 | 20 | 300 | 200 | 3% | 29% |
| Example 2 | Pressurizing member 2 | 40 | 310 | 200 | 2% | 38% |
| Example 3 | Pressurizing member 3 | 60 | 310 | 200 | 3% | 42% |
| Example 4 | Pressurizing member 4 | 20 | 300 | 190 | 8% | 32% |
| Example 5 | Pressurizing member 5 | 40 | 310 | 190 | 7% | 38% |
| Example 6 | Pressurizing member 6 | 60 | 310 | 190 | 8% | 44% |
| Example 7 | Pressurizing member 7 | 60 | 330 | 170 | 13% | 50% |
| Example 8 | Pressurizing member 8 | 20 | 300 | 170 | 12% | 28% |
| Example 9 | Pressurizing member 9 | 40 | 310 | 170 | 13% | 36% |
| Example 10 | Pressurizing member 10 | 40 | — | — | 0% | 42% |
| Comparative Example 1 | Pressurizing member A-1 | 20 | — | — | 0% | 0% |
| Comparative Example 2 | Pressurizing member A-2 | 40 | — | — | 0% | 0% |
| Comparative Example 3 | Pressurizing member A-3 | 60 | — | — | 0% | 0% |
| Comparative Example 4 | Pressurizing member A-4 | 80 | — | — | 0% | 0% |
| Comparative Example 5 | Pressurizing member B-1 | 20 | 300 | 150 | 17% | 28% |
| Comparative Example 6 | Pressurizing member B-2 | 40 | 310 | 150 | 19% | 36% |
| Comparative Example 7 | Pressurizing member C | 40 | — | — | 40% | 38% |
| Comparative Example 8 | Pressurizing member D | 40 | 300 | — | 20% | 20% |

TABLE 2

| | Sample name | Surface resistivity Ω/□ | Presence or absence of electrostatic offset — | Thermal conductivity in thickness direction $\times 10^{-2}$ W/(m · K) | Start time [Second(s)] | Evaluation of delay of start time — |
|---|---|---|---|---|---|---|
| Example 1 | Pressurizing member 1 | $1 \times 10^{8}$ | A | 9.2 | 7.6 | B |
| Example 2 | Pressurizing member 2 | $1 \times 10^{8}$ | A | 8.8 | 6.9 | A |
| Example 3 | Pressurizing member 3 | $1 \times 10^{8}$ | A | 8.2 | 7.0 | A |
| Example 4 | Pressurizing member 4 | $1 \times 10^{10}$ | A | 8.4 | 6.9 | A |
| Example 5 | Pressurizing member 5 | $1 \times 10^{10}$ | A | 8.7 | 7.0 | A |
| Example 6 | Pressurizing member 6 | $1 \times 10^{10}$ | A | 8.2 | 7.1 | A |
| Example 7 | Pressurizing member 7 | $1 \times 10^{11}$ | B | 7.9 | 7.4 | A |

TABLE 2-continued

| | Sample name | Surface resistivity Ω/□ | Presence or absence of electrostatic offset — | Thermal conductivity in thickness direction $\times 10^{-2}$ W/(m · K) | Start time [Second(s)] | Evaluation of delay of start time — |
|---|---|---|---|---|---|---|
| Example 8 | Pressurizing member 8 | $1 \times 10^{11}$ | B | 9.3 | 7.8 | B |
| Example 9 | Pressurizing member 9 | $1 \times 10^{11}$ | B | 8.5 | 7.1 | A |
| Example 10 | Pressurizing member 10 | $1 \times 10^{7}$ | A | 8.3 | 7.0 | A |
| Comparative Example 1 | Pressurizing member A-1 | $1 \times 10^{7}$ | A | 17 | 9.6 | C |
| Comparative Example 2 | Pressurizing member A-2 | $1 \times 10^{7}$ | A | 17 | 9.5 | C |
| Comparative Example 3 | Pressurizing member A-3 | $1 \times 10^{7}$ | A | 17 | 9.4 | C |
| Comparative Example 4 | Pressurizing member A-4 | $1 \times 10^{7}$ | A | 17 | 9.3 | C |
| Comparative Example 5 | Pressurizing member B-1 | $1 \times 10^{11.5}$ | C | 9.1 | 7.7 | B |
| Comparative Example 6 | Pressurizing member B-2 | $1 \times 10^{12}$ | C | 8.7 | 7.0 | A |
| Comparative Example 7 | Pressurizing member C | $1 \times 10^{12}$ | C | 8.8 | 6.9 | A |
| Comparative Example 8 | Pressurizing member D | $1 \times 10^{12}$ | C | 12 | 8.9 | C |

It was found from Table 2 that the pressurizing member according to this aspect showed an excellent surface resistivity and showed an excellent thermal conductivity, and hence, as a result, was able to shorten the start time while preventing the electrostatic offset.

In addition, it was found that when the porosity ΦA of the region A was set to 0% or more and 13% or less, the surface resistivity was able to be set to $1\times10^{11}$ [Ω/□] or less, and when the porosity ΦB of the region B was set to 28% or more and 50% or less, the thermal conductivity was able to be set to 0.093 [W/(m·K)] or less.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-094732, filed Jun. 4, 2021, which is hereby incorporated by reference herein in its entirety.

What is claimed is:

1. A pressurizing member comprising:

a substrate;

an elastic layer on the substrate; and a surface layer on the elastic layer, the surface layer containing a fluorine resin, wherein the surface layer has a surface resistivity of $1\times10^{11}$ [Ω/□] or less at a temperature of 25° C. when applying a DC voltage of 500 V, and a thermal conductivity λ in a thickness direction of the surface layer is 0.093 [W/(m·K)] or less.

2. The pressurizing member according to claim 1, wherein the surface layer is constituted by a single layer.

3. The pressurizing member according to claim 1, wherein the surface layer is constituted by a laminate including at least two layers.

4. The pressurizing member according to claim 1, wherein when obtaining a cross section of the surface layer in a total thickness direction of the surface layer by cutting the surface layer in parallel to a longitudinal direction of the pressurizing member, and when defining a region ranging from an outer surface of the surface layer to a position at a depth of 5 μm from the outer surface in the cross section as a region A, and putting a first observation region in a shape of square 5 μm on a side at an arbitrary position in the region A, a porosity ΦA of the first observation region is 0% or more and 13% or less.

5. The pressurizing member according to claim 1, wherein when obtaining a cross section of the surface layer in a total thickness direction of the surface layer by cutting the surface layer in parallel to a longitudinal direction of the pressurizing member, and when defining a region ranging from a positon at a depth of 5 μm from an outer surface of the surface layer to a surface opposite to the outer surface as a region B, and putting a second observation region in a shape of square 10 μm on a side at an arbitrary position in the region B, a porosity ΦB in the second observation region is 28% or more and 50% or less.

6. The pressurizing member according to claim 1, wherein the surface layer has a thickness of 12 μm or more.

7. The pressurizing member according to claim 1, wherein the surface layer contains an electro-conductive material.

8. The pressurizing member according to claim 1, wherein the fluorine resin is a PFA.

9. The pressurizing member according to claim 1, wherein the elastic layer is a solid rubber layer.

10. The pressurizing member according to claim 1, wherein the pressurizing member is a pressurizing roller.

11. A fixing device comprising:

a pressurizing member; and a fixing belt arranged to face the pressurizing member, wherein the pressurizing member includes a substrate, an elastic layer on the substrate, and a surface layer on the elastic layer, the surface layer containing a fluorine resin, and wherein the surface layer has a surface resistivity of $1\times10^{11}$ [Ω/□] or less at a temperature of 25° C. when applying a DC voltage of 500 V, and a thermal conductivity λ in a thickness direction of the surface layer is 0.093 [W/(m·K)] or less.

12. An electrophotographic image-forming apparatus comprising a fixing device, wherein the fixing device includes a pressurizing member and a fixing belt arranged to face the pressurizing member, wherein the pressurizing member includes a substrate, an elastic layer on the substrate, and a surface layer on the elastic layer, the surface layer containing a fluorine resin, and wherein the surface layer has a surface resistivity of $1\times10^{11}$ [Ω/□] or less at a temperature of 25° C. when applying a DC voltage of 500 V, and a thermal conductivity λ in a thickness direction of the surface layer is of 0.093 [W/(m·K)] or less.

* * * * *